US007878830B2

(12) United States Patent
Duesterhoeft et al.

(10) Patent No.: US 7,878,830 B2
(45) Date of Patent: Feb. 1, 2011

(54) ELECTRICAL CONNECTOR ORGANIZER

(75) Inventors: Scott Stephen Duesterhoeft, Etters, PA (US); Robert N. Mulfinger, York Haven, PA (US); Keith McQuilkin Murr, York, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 245 days.

(21) Appl. No.: 12/177,705

(22) Filed: Jul. 22, 2008

(65) Prior Publication Data

US 2010/0022112 A1 Jan. 28, 2010

(51) Int. Cl.
*H01R 13/64* (2006.01)

(52) U.S. Cl. ..... 439/248; 439/247

(58) Field of Classification Search ..... 439/248, 439/246, 247, 249

See application file for complete search history.

(56) References Cited

U.S. PATENT DOCUMENTS 4,423,917 A * 1/1984 Scheingold et al. ..... 439/249
5,328,381 A * 7/1994 Seymour et al. ..... 439/247
5,431,576 A * 7/1995 Matthews ..... 439/247
6,629,853 B2 10/2003 Whitemen
6,783,380 B1 * 8/2004 Kamath et al. ..... 439/247
6,790,046 B2 * 9/2004 Haffenden et al. ..... 439/6
6,908,326 B2 * 6/2005 Shiota et al. ..... 439/247

OTHER PUBLICATIONS

"QSL RF Connector System", Copyright 2007 by Tyco Electronics Corporation, pp. 1-5 (www.tycoelectronics.com/products/rfcoax).

* cited by examiner

*Primary Examiner*—Xuong M Chung Trans

(57) ABSTRACT

An electrical connector assembly includes a housing, a receptacle and a receptacle contact. The housing has an interior chamber between a cable end and an interface of the housing. The interface is configured to receive a mating end of a mating electrical connector. The receptacle contact is disposed within a slot of the receptacle and is configured to engage a corresponding contact in the mating electrical connector. The receptacle contact is pivotally mounted in the receptacle and configured to pivot about a pitch axis and along the slot of the receptacle to align with the corresponding contact in the mating electrical connector. Optionally, the receptacle is mounted so as to pivot in the interior chamber and is configured to pivot about a yaw axis within the interior chamber over a predetermined limited range of travel to align the receptacle contact with the corresponding contact in the mating electrical connector.

19 Claims, 10 Drawing Sheets

ELECTRICAL CONNECTOR ORGANIZER

BACKGROUND OF THE INVENTION

The subject matter herein relates generally to electrical connectors, and more particularly, to electrical connectors mounted to a panel or circuit board of an electrical device or system.

Some electrical systems and devices today are designed to include electrical connectors having multiple receptacles along the panels or walls of an electrical system or device, such as a portable computer. For example, QSL RF connector systems may include three receptacles that each includes an electrical contact or pair of electrical contacts. For example, QSL RF connector systems may include multiple receptacles each having a signal contact and a ground contact. The receptacles may allow an operator of the system to establish an electrical connection between the electrical connector and a peripheral device (for example, an RF antenna).

The peripheral device may be interconnected with a mating end by a cable. The mating end includes a plurality of electrical contacts that may be housed in a plug end. The peripheral device and electrical connector may be electrically connected by mating the plug with the receptacles in the electrical connector. The electrical contacts in the mating end engage a plurality of electrical contacts in the receptacles of the electrical connector.

However, many known connectors do not provide a manner for assembling three or more individual receptacles in a single connector. Thus, a need exists for a connector that is capable of being assembled with three or more individual receptacles in the connector.

BRIEF DESCRIPTION OF THE INVENTION

In one embodiment, an electrical connector assembly is provided. The electrical connector includes a housing, a receptacle and a receptacle contact. The housing has an interior chamber between a cable end and an interface of the housing. The interface is configured to receive a mating end of a mating electrical connector. The receptacle is held in the housing at the interface. The receptacle contact is disposed within a slot of the receptacle and is configured to engage a corresponding contact in the mating electrical connector. The receptacle contact is pivotally mounted in the receptacle and configured to pivot about a pitch axis and along the slot of the receptacle to align with the corresponding contact in the mating electrical connector.

In another embodiment, another electrical connector assembly is provided. The electrical connector assembly includes a housing, a receptacle and a receptacle contact. The housing has an interior chamber between a cable end and an interface of the housing. The interface is configured to receive a mating end of a mating electrical connector. The receptacle is held in the housing at the interface and is mounted so as to pivot in the interior chamber. The receptacle is configured to pivot about a yaw axis within the interior chamber over a predetermined limited range of travel. The receptacle contact is disposed within the receptacle and is configured to engage a corresponding contact in the mating electrical connector. The receptacle is capable of pivoting about the yaw axis to align the receptacle contact with the corresponding contact in the mating electrical connector.

In another embodiment, another electrical connector assembly is provided. The electrical connector assembly includes a housing, a receptacle and a receptacle contact. The housing has an interior chamber between a cable end and an interface of the housing. The interface is configured to receive a mating end of a mating electrical connector. The receptacle is held in the housing at the interface and is mounted in the interior chamber so as to pivot in the interior chamber. The receptacle is configured to pivot about a yaw axis within the interior chamber over a predetermined limited range of travel. The receptacle contact is disposed within a slot of the receptacle and is configured to engage a corresponding contact in the mating electrical connector. The receptacle contact is pivotally mounted in the receptacle and is configured to pivot about a pitch axis and along the slot of the receptacle. The receptacle is configured to pivot about the yaw axis and the receptacle contact is configured to pivot about the pitch axis to align the receptacle contact with the corresponding contact in the mating electrical connector.

DETAILED DESCRIPTION OF THE INVENTION

Figure 1:
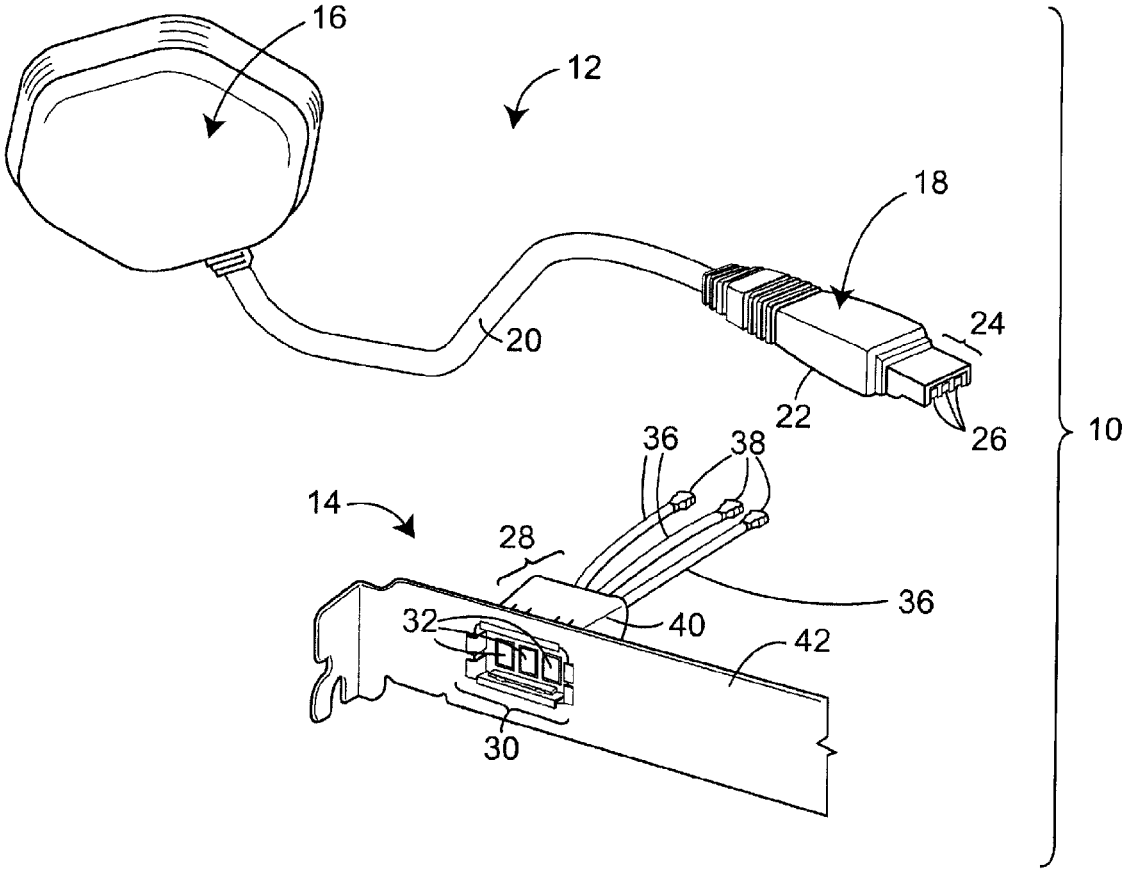
FIG. 1 is a perspective view of an electrical connector assembly including a device assembly and a receptacle connector assembly according to one exemplary embodiment.

FIG. 1 is a perspective view of an electrical connector assembly 10 according to one exemplary embodiment. The connector assembly 10 includes a device assembly 12 and a receptacle connector assembly 14. The device and receptacle connector assemblies 12, 14 mate with one another to permit electrical communication between the device and receptacle connector assemblies 12, 14.

The device assembly 12 includes a peripheral device 16 interconnected with an electrical connector 18 of a device cable 20. In the illustrated embodiment, the device 16 is an RF antenna. In one or more other embodiments, the device 16 can include any other electronic component capable of communicating with the receptacle connector assembly 14. For example, the device 16 may include a mobile antenna, a Global Positioning System ("GPS") device, a radio device, a handheld computing device such as a Personal Digital Assistant ("PDA"), a mobile phone, an automotive telematic device, a WiFi device, a WiMax device, a data device, and the like. In some embodiments, the device 16 is an antenna capable of communicating using three different frequency ranges. For example, the device 16 may include a triple dipole 802.11 a/b/g/n antenna.

The cable 20 is capable of communicating data between the device 16 and the electrical connector 18. For example, the cable 20 may include a center conductive wire (not shown) enclosed by an insulator. In some embodiments, the cable 20 includes at least three wires.

The electrical connector 18 includes a housing 22 having a mating end 24. The mating end 24 is shaped to be inserted into the receptacle connector assembly 14. A plurality of electrical contacts 26 are provided near the mating end 24. In one embodiment, each of the electrical contacts 26 includes a plurality of contacts. For example, each of the electrical contacts 26 may include a signal contact and a ground contact. While three electrical contacts 26 are shown in the illustrated embodiment, a different number of electrical contacts 26 may be used. The wires in the cable 20 terminate to one or more of the electrical contacts 26. The mating end 24 is inserted into the receptacle connector assembly 14 to establish a conductive path between the device 16 and the receptacle connector assembly 14. For example, the mating end 24 is inserted into the receptacle connector assembly 14 to close a circuit that includes the device 16, the wires in the cable 20, the electrical contacts 26 and the receptacle connector assembly 14.

The receptacle connector assembly 14 includes a housing 28 having an interface 30. The housing 28 is mounted to a chassis panel 42 in the illustrated embodiment. In one or more other embodiments, the housing 28 may be mounted to a circuit board (not shown). In the illustrated embodiment, the housing 28 is configured to receive the mating end 24 of the device assembly 12 through the interface 30. A plurality of receptacles 32 are aligned in the interface 30 to receive the electrical contacts 26 in the mating end 24. For example, each of the receptacles 32 may receive one of the electrical contacts 26 when the mating end 24 is inserted into the housing 28. While three receptacles 32 are shown in the illustrated embodiment, a different number of receptacles 32 may be provided.

Alternatively, the mating end 24 may be configured to receive the receptacle connector assembly 14. For example, the receptacles 32 may be inserted into the mating end 24 to establish an electrical connection between the device and receptacle connector assemblies 12, 14.

A center contact 34 (shown in FIG. 3) is held in each of the receptacles 32. In one embodiment, each center contact 34 includes a plurality of contacts. For example, each center contact 34 may include a signal contact and a ground contact. The center contact 34 in each receptacle 32 engages the electrical contacts 26 to establish an electric connection between the device assembly 12 and the receptacle connector assembly 14 when the mating end 24 is inserted into the housing 28. Each of the center contacts 34 is connected to one of a plurality of cables 36. For example, a conductive wire (not shown) in each of the cables 36 may be terminated to one of the center contacts 34. The cables 36 include a mating end 38. The mating ends 38 mate with electrical contacts (not shown) on a circuit board (not shown). For example, the mating ends 38 may be placed over a conductive post extending from a circuit board. In another example, the mating ends 38 may be inserted into an opening in a circuit board. The mating ends 38 may be electrically connected to one or more conductive traces (not shown) in the circuit board in order to establish an electrical connection with the circuit board.

In the illustrated embodiment, the housing 28 is partially enclosed within a shield shell 40. The shield shell 40 may shield the receptacle connector assembly 14 from electromagnetic interference. For example, the shield shell 40 may be connected to the electrical ground via the chassis panel 42 to shield the receptacle connector assembly 14.

Figure 2:
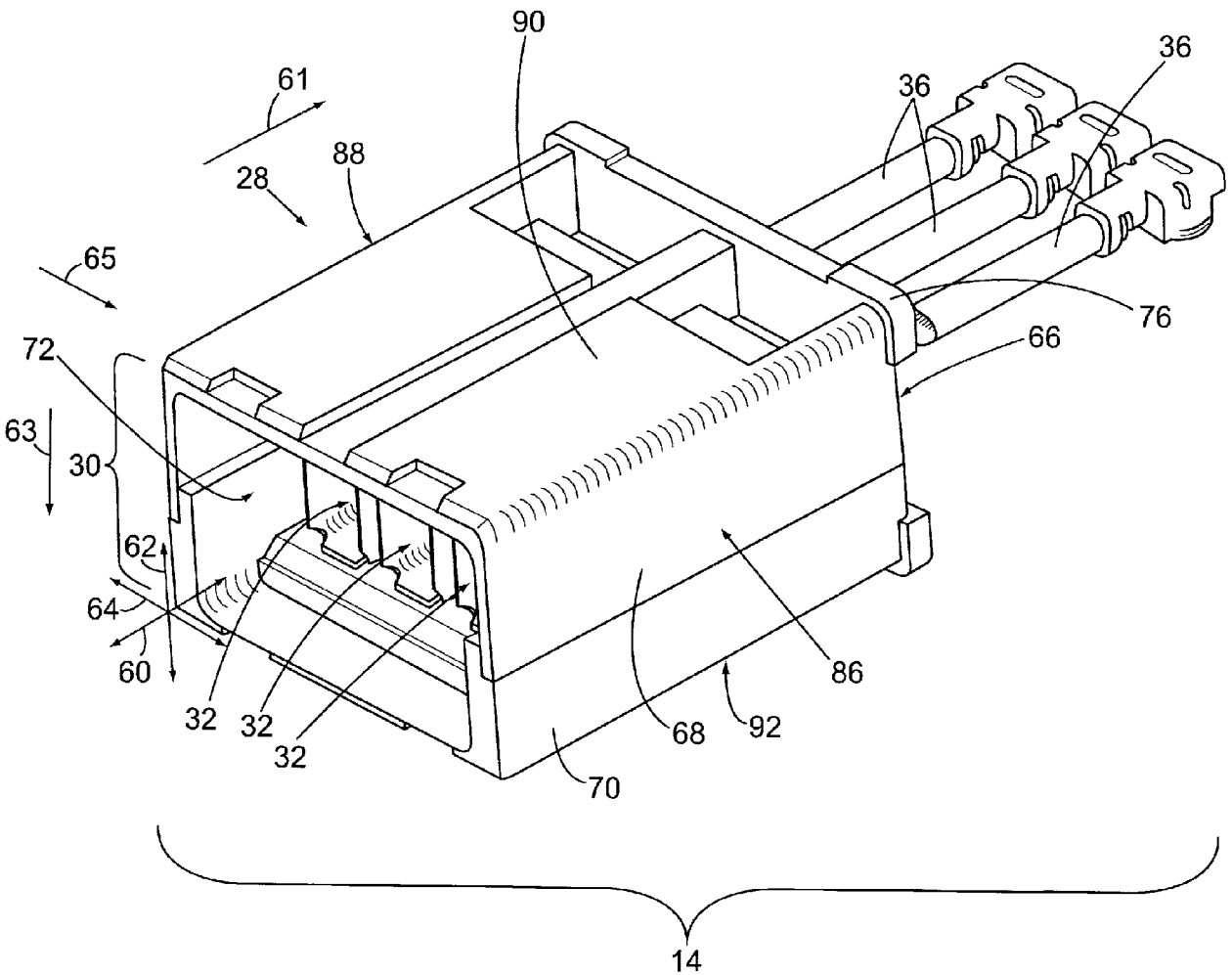
FIG. 2 is a front perspective view of the receptacle connector assembly shown in FIG. 1 with a shield shell removed.

FIG. 2 is a front perspective view of the receptacle connector assembly 14 with the shield shell 40 removed. As shown in FIG. 2, the housing 28 has an elongated shape that extends in a direction 61 parallel to a housing longitudinal axis 60 between the opposing interface 30 and a cable end 66. An interior chamber 72 of the housing 28 is located between the interface 30 and the cable end 66. The interface 30 and the cable end 66 extend in a direction 63 parallel to a housing transverse axis 62 between top and bottom sides 90, 92 of the housing 28. The housing transverse axis 62 is transverse to the housing longitudinal axis 60. In the illustrated embodiment, the housing longitudinal and transverse axes 60, 62 are substantially perpendicular to one another. The interface 30 and cable end 66 extend in a direction 65 parallel to a housing lateral axis 64 between opposing sides 86, 88 of the housing 28. In the illustrated embodiment, the housing lateral axis 64 is substantially perpendicular to the housing longitudinal and transverse axes 60, 62. In another embodiment, two or more of the housing longitudinal, transverse and lateral axes 60, 62, 64 are not orthogonal to one another. For example, two or more of the housing longitudinal, transverse and lateral axes 60, 62, 64 may be disposed at an acute or obtuse angle with respect to one another.

The housing 28 may include a top portion 68 and a bottom portion 70. As described below, the top and bottom portions 68, 70 have complementary shapes so that the top and bottom portions 68, 70 mate with one another to form the housing 28 and to at least partially enclose the receptacles 32.

Figure 3:
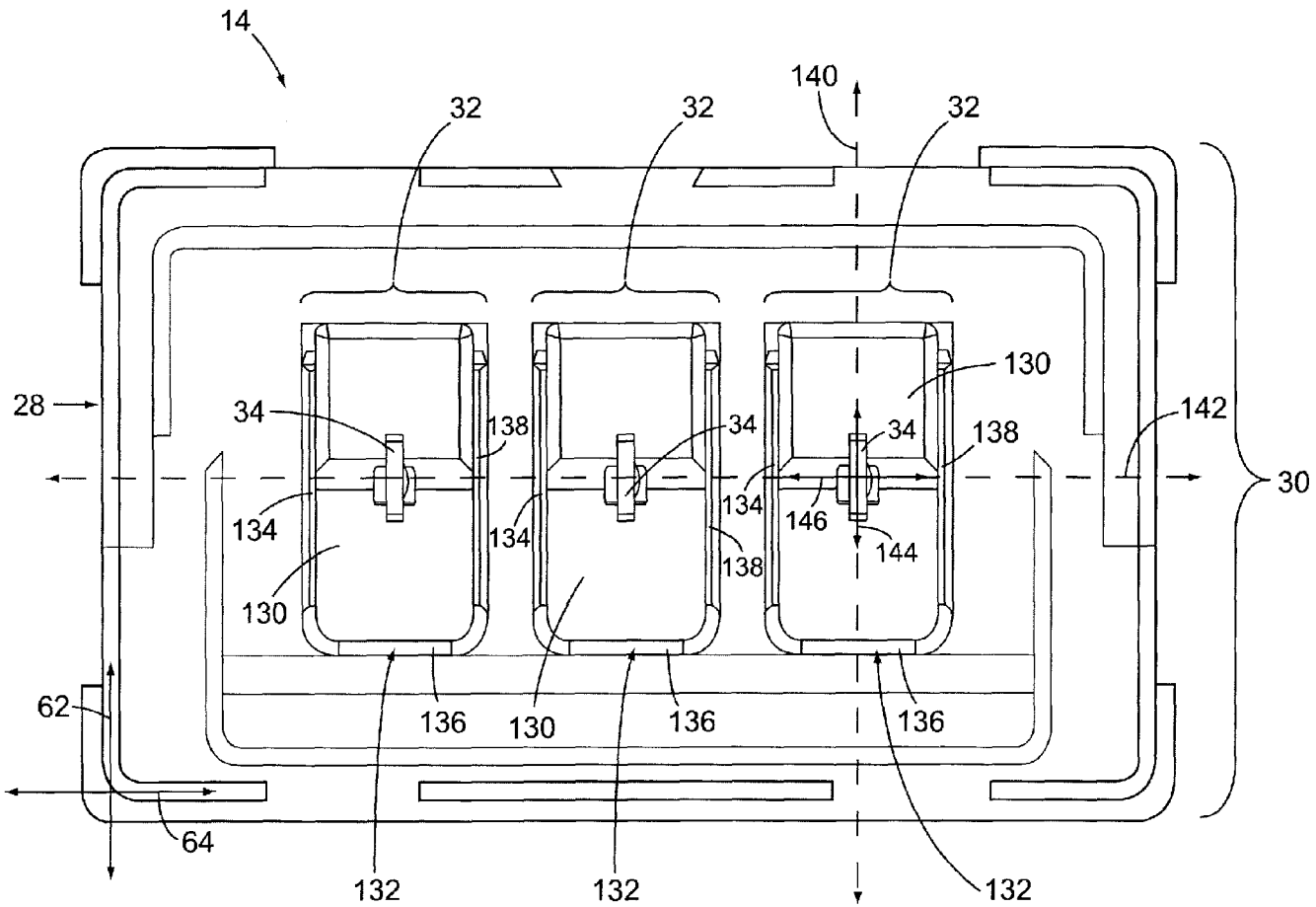
FIG. 3 is an elevational view of an interface of the receptacle connector assembly shown in FIG. 1 with the shield shell removed.

FIG. 3 is an elevational view of the interface 30 of the receptacle connector assembly 14 with the shield shell 40 removed. As shown in FIG. 3, each of the receptacles 32 is held by the housing 28. Each of the receptacles 32 includes a dielectric body 130, an internal shield 132 and one of the center contacts 34.

Each of the dielectric bodies 130 may include, or be formed from, a dielectric material. For example, the dielectric bodies 130 may be formed from a plastic material. Each of the dielectric bodies 130 holds one of the center contacts 34. In one embodiment, the dielectric bodies 130 electrically isolate the center contacts 34 from the housing 28 and the shield shell 40 (shown in FIGS. 1 and 3).

The internal shields 132 each include a plurality of opposing sidewalls 134, 138 and a bottom wall 136. The bottom wall 136 is substantially perpendicular to the sidewalls 134, 138. Each of the internal shields 132 at least partially encloses one of the dielectric bodies 130. In one embodiment, the internal shields 132 are electrically connected to the electrical ground. For example, the internal shields 132 may be electrically connected to the electrical ground of the cables 36 (shown in FIG. 1). The internal shields 132 may protect the center contacts 34 from electromagnetic interference.

As described above, each of the electrical contacts 26 (shown in FIG. 1) is inserted into one of the receptacles 32. Each of the electrical contacts 26 engages corresponding ones of the internal shields 132 and the dielectric bodies 130 so that an electrical connection is established between the electrical contacts 26 and the center contacts 34.

Figure 9:
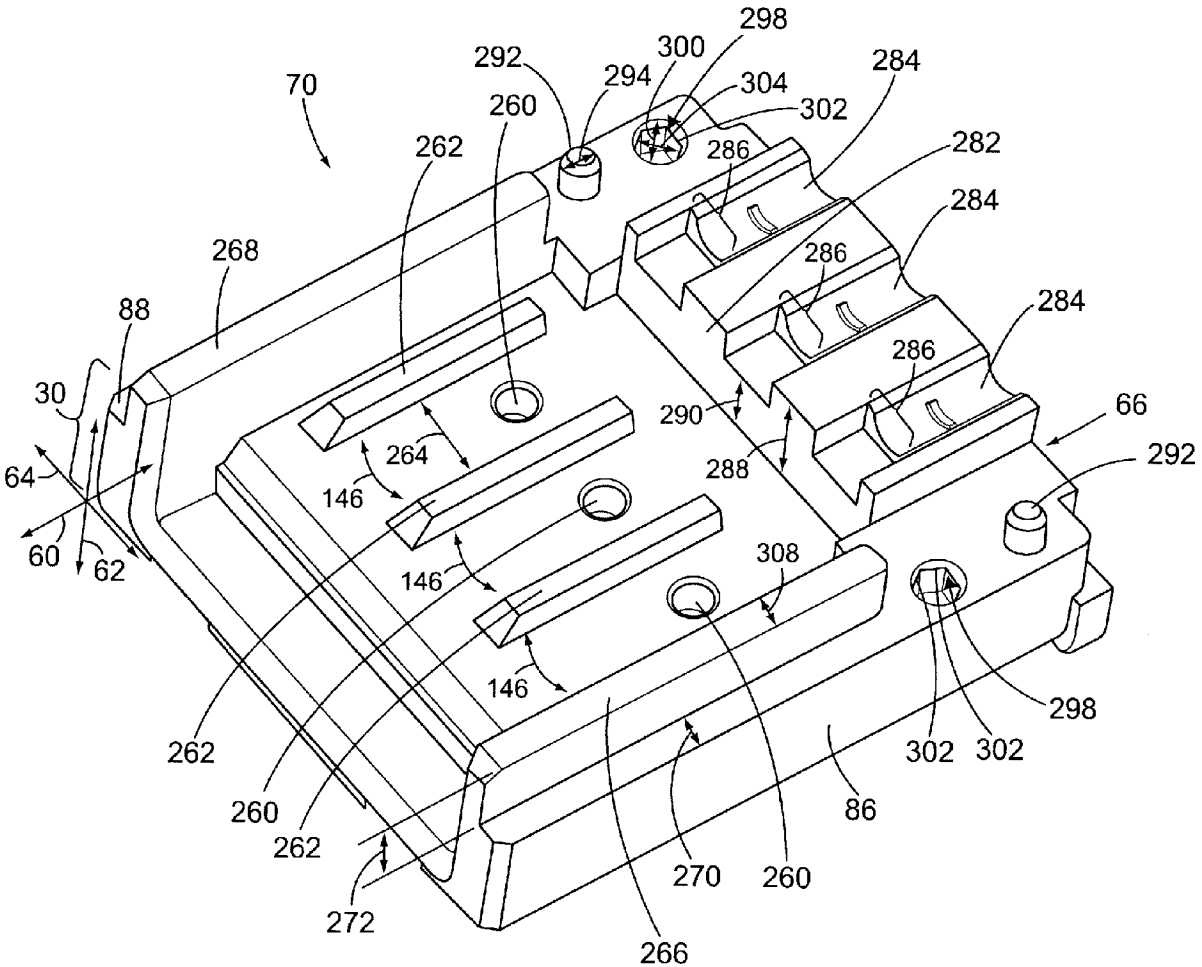
FIG. 9 is a top perspective view of a bottom portion of a housing of the receptacle connector assembly shown in FIGS. 2 and 4.

In the illustrated embodiment, a yaw axis 140 extends through each of the receptacles 32 in a direction that is substantially parallel to the transverse axis 62 of the housing 28. The receptacles 32 may each pivot in opposing directions about the yaw axis 140. As the receptacles 32 pivot about the yaw axis 140, the center contacts 34 that are held in the receptacles 32 may each be moved accordingly. For example, as the receptacles 32 pivot about the yaw axis 140, the center contacts 34 also are moved along with the receptacles 32 in a yaw direction 146. The yaw direction 146 is an arc that extends between ribs 262 (shown in FIG. 9) that limit the amount of travel of the receptacles 32. The arc of the yaw direction 146 also is shown in FIG. 9. For example, the contacts 34 may move about an arc that is represented by the yaw direction 146 in the two-dimensional view shown in FIG. 3 when the receptacles 32 pivot about the yaw axis 140. In one embodiment, each receptacle 32 pivots about the yaw axis 140 relative to the housing 28. For example, the housing 28 may remain stationary while one or more of the receptacles 32 pivot about the yaw axis 140.

Figure 7:
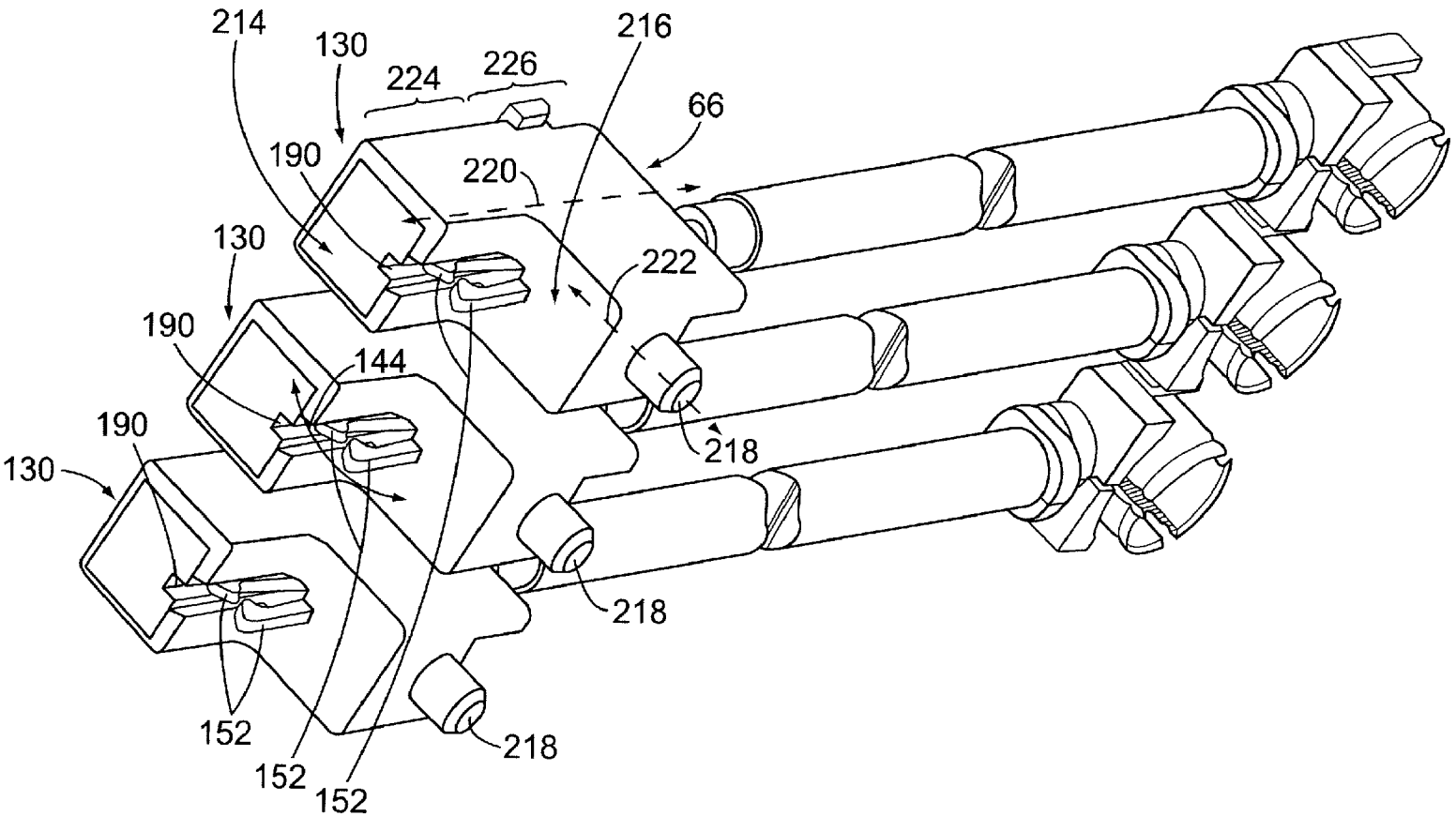
FIG. 7 is a bottom perspective view of the dielectric bodies shown in FIG. 3 with the center contacts inserted therein.

A pitch axis 142 of each of the receptacles 32 extends through each of the center contacts 34. In the illustrated embodiment, the pitch axis 142 extends along a direction that is substantially parallel to the lateral axis 64 of the housing 28. The pitch axis 142 may extend through a contact lateral axis 172 (shown in FIG. 4) and through a dimple 154 (shown in FIG. 4) of the contact 34. As described below, the dimple 154 may provide the pitch axis 142 and the ability of the contact 34 to pivot about the pitch axis 142. The center contacts 34 may each pivot in opposing directions about the pitch axis 142. As the center contacts 34 pivot about the pitch axis 142, the center contacts 34 may each partially move in opposing directions along a pitch direction 144. For example, the center contacts 34 may move about an arc that is represented by the pitch direction 144 in the two-dimensional view shown in FIG. 3 when the center contacts 34 pivot about the pitch axis 142. The pitch direction 144 is an arc that also is shown in FIG. 7. In one embodiment, each center contact 34 pivots about the pitch axis 142 relative to the dielectric body 130 that holds the center contact 34. Each center contact 34 may pivot about the pitch axis 142 relative to the housing 28. For example, the housing 28 and/or dielectric body 130 may remain stationary while a corresponding one of the center contacts 34 pivots about the pitch axis 142.

In one embodiment, each of the receptacles 32 pivots about the yaw axis 140 independent of one another. For example, one of the receptacles 32 may pivot about the yaw axis 140 to cause a corresponding center contact 34 to move in one direction along the yaw direction 146 while a neighboring receptacle 32 does not pivot or pivots about the yaw axis 140 to cause a corresponding center contact 34 to move in an opposing direction along the yaw direction 146.

In one embodiment, each of the center contacts 34 pivots about the pitch axis 142 independent of one another. For example, one of the center contacts 34 may pivot about the pitch axis 142 to move in one direction along the pitch direction 144 while a neighboring center contact 34 does not pivot or pivots about the pitch axis 142 to move in an opposing direction along the pitch direction 144.

Figure 4:
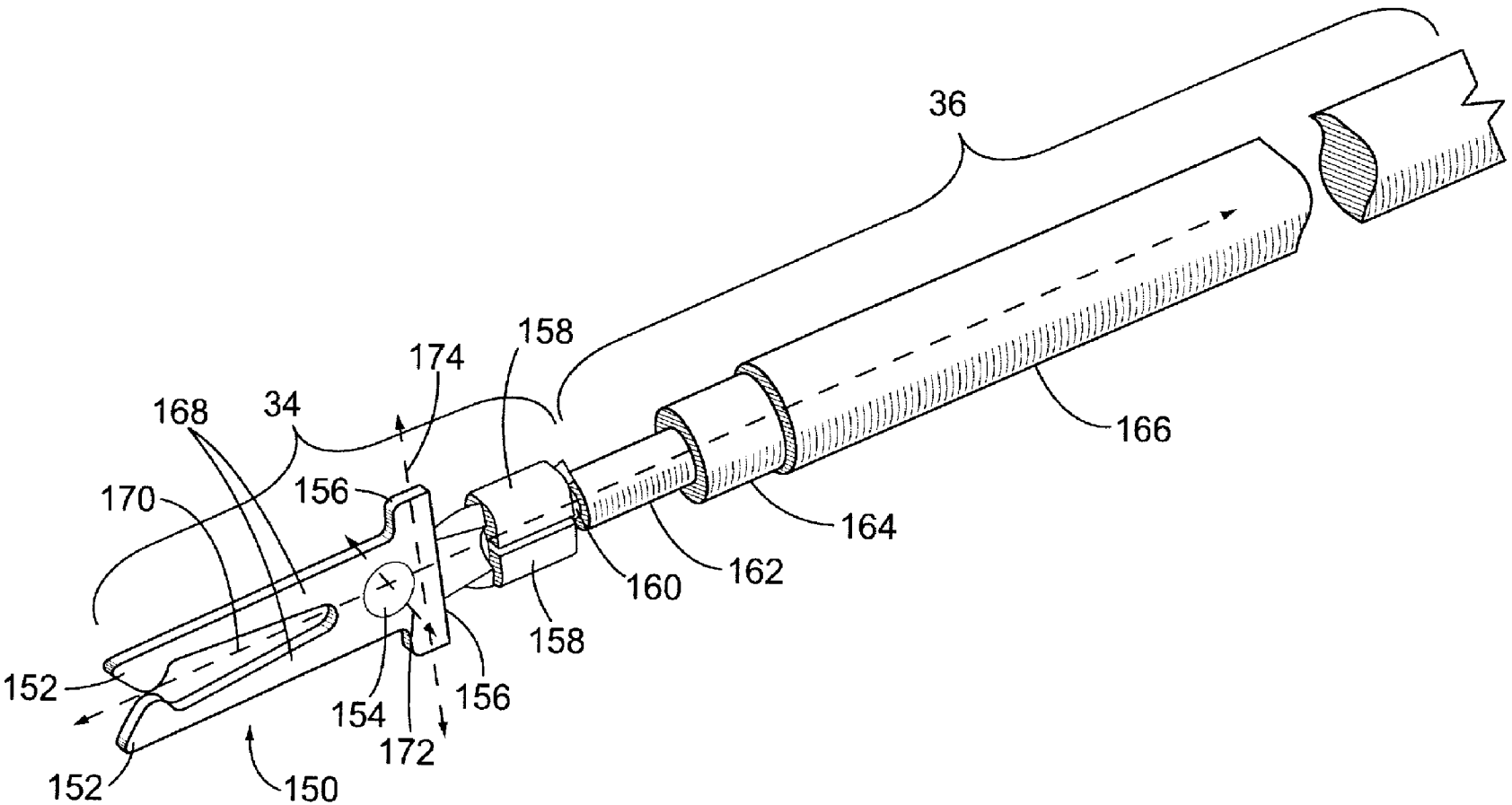
FIG. 4 is a front perspective view of a center contact and a cable shown in FIGS. 1 and 3.

FIG. 4 is a front perspective view of one of the center contacts 34 and corresponding cable 36. The center contact 34 is elongated along a contact longitudinal axis 170. In one embodiment, the contact longitudinal axis 170 is substantially parallel to the housing longitudinal axis 60 (shown in FIG. 2).

In the illustrated embodiment, the center contact 34 includes a fork contact end 150. The fork contact end 150 includes a plurality of beams 168 extending to a plurality of tips 152. The tips 152 may mechanically engage the electrical contacts 26 (shown in FIG. 1) to establish an electrical connection between the cable 20 (shown in FIG. 1) and the center contact 34. For example, the tips 152 may be biased away from one another when one of the electrical contacts 26 is received by the center contact 34. The tips 152 may at least partially return to an unbiased position once one of the electrical contacts 26 is fully inserted into the corresponding receptacle 32 (shown in FIGS. 1 and 3) and the electrical contact 26 is fully received by the center contact 34.

The center contact 34 includes one or more dimples 154. In one embodiment, the dimple 154 is a protrusion of the center contact 34 that extends away from the center contact 34 along the contact lateral axis 172. In one embodiment, the contact lateral axis 172 is substantially parallel to the pitch axis 142 (shown in FIG. 3). In one embodiment, the center contact 34 includes a single dimple 154 extending from one side of the center contact 34. In another embodiment, the center contact 34 has two dimples 154 that extend from both sides of the center contact 34 in opposing directions along the contact lateral axis 172. In the illustrated embodiment, the dimple 154 is convex and has a spherical shape. For example, the dimple 154 may have the shape of a portion of a sphere.

The dimple 154 contacts the dielectric body 130 (shown in FIG. 3) and permits the center contact 34 to at least partially pivot about the pitch axis 142 (shown in FIG. 3). For example, the dimple 154 may contact the dielectric body 130 and provide a pivot axis for the center contact 34. The center contact 34 may then pivot about the pitch axis 142 to move the center contact 34 and the tips 152 in opposing directions along the pitch direction 144 (shown in FIG. 3). The center contact 34 and the tips 152 may be moved along the pitch direction 144 in order to align the center contact 34 and/or tips 152 with respect to the electrical contacts 26 (shown in FIG. 1) when each of the electrical contacts 26 is inserted into the corresponding receptacle 32. For example, the tips 152 may pivot so that the tips 152 align with the electrical contacts 26.

The center contact 34 includes one or more fins 156 between the fork contact end 150 and one or more contact tabs 158. In the illustrated embodiment, the fins 156 include extensions of the center contact 34 that extend along a contact transverse axis 174. In the illustrated embodiment, the contact transverse axis 174 is substantially perpendicular to the contact longitudinal axis 170 and the contact lateral axis 172. The contact transverse axis 174 may be substantially parallel to the yaw axis 140 (shown in FIG. 3). The fins 156 may be used to align the center contact 34 in the dielectric body 130 (shown in FIG. 3). For example, the fins 156 may align the center contact 34 when the center contact 34 is inserted into a dielectric body 130. The fins 156 may prevent the center contact 34 from pivoting about the yaw axis 140 (shown in FIG. 3). The contact tabs 158 engage a conductive core 160 of the cable 36 to provide an electrical connection between the center contact 34 and the cable 36. In one embodiment, the contact tabs 158 are crimped onto the conductive core 160 to establish the electrical connection. Alternatively, the conductive core 160 may be soldered to the center contact 34 in a location that is proximate to the fins 156 or the contact tabs 158.

In the illustrated embodiment, the cable 36 is a coaxial cable. For example, the cable 36 may include the conductive core 160 surrounded by a dielectric spacer 162. The dielectric spacer 162 is surrounded by a conductive sheath 164. The conductive sheath 164 is enclosed within a dielectric jacket 166. The conductive core 160 may include one or more wires that carries data and/or power signals from the center contact 34 to the mating end 38 (shown in FIG. 1) of the cable 36. The conductive core 160 may include, or be formed from, a conductive material, such as a metal or metal alloy.

The dielectric spacer 162 separates the conductive core 160 from the conductive sheath 164. The dielectric spacer 162 includes, or is formed from, a dielectric material, such as a plastic. In one embodiment, the dielectric spacer 162 electrically isolates the conductive core 160 from the conductive sheath 164.

The conductive sheath 164 may shield the conductive core 160 from electromagnetic interference. For example, the conductive sheath 164 may be electrically connected to the electrical ground. The conductive sheath 164 may be electrically connected to the electrical ground of the circuit board (not shown) to which the mating ends 38 (shown in FIG. 1) of the cables 36 are mounted. The dielectric jacket 166 encloses the conductive sheath 164. The dielectric jacket 166 may include, or be formed from, a dielectric material, such as a plastic. The dielectric jacket 166 may electrically isolate and protect the conductive sheath 164.

Figure 5:
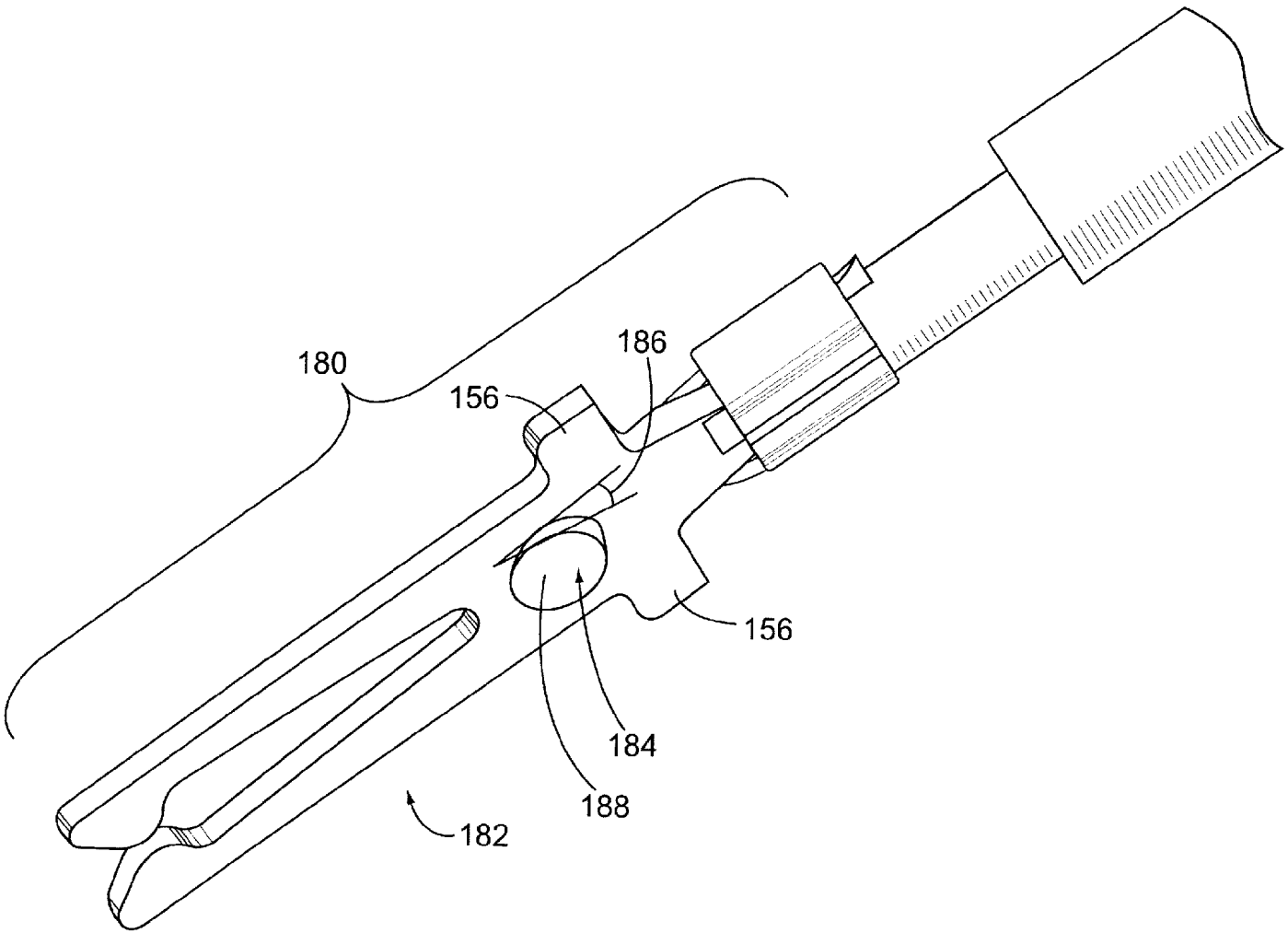
FIG. 5 is a front perspective view of a center contact according to an alternative embodiment.

FIG. 5 is a front perspective view of a center contact 180 according to an alternative embodiment. The center contact 180 may be similar to the center contact 34 shown in FIG. 4. The center contact 180 includes a fork contact end 182, similar to the fork contact end 150 (shown in FIG. 4) of the center contact 34. The center contact 180 includes one or more dimples 184. The dimple 184 is similar to the dimple 154 of the center contact 34. In the illustrated embodiment, the dimple 184 has a circular cross-section. The dimple 184 has a flat surface 188 that extends away from the center contact 180 at an angle 186. The flat surface 188 is generally forward facing in one embodiment. In the illustrated embodiment, the angle 186 is an acute angle. In one embodiment, the angle 186 is sufficiently small to permit the relatively easy insertion of the center contact 34 into a slot 190 (shown in FIG. 6) of the dielectric body 130 (shown in FIG. 3). For example, the angle 186 may be 30 degrees or less. In another embodiment, the angle 186 is 15 degrees or less. In one embodiment, the angle 186 is at least 15 degrees.

Figure 6:
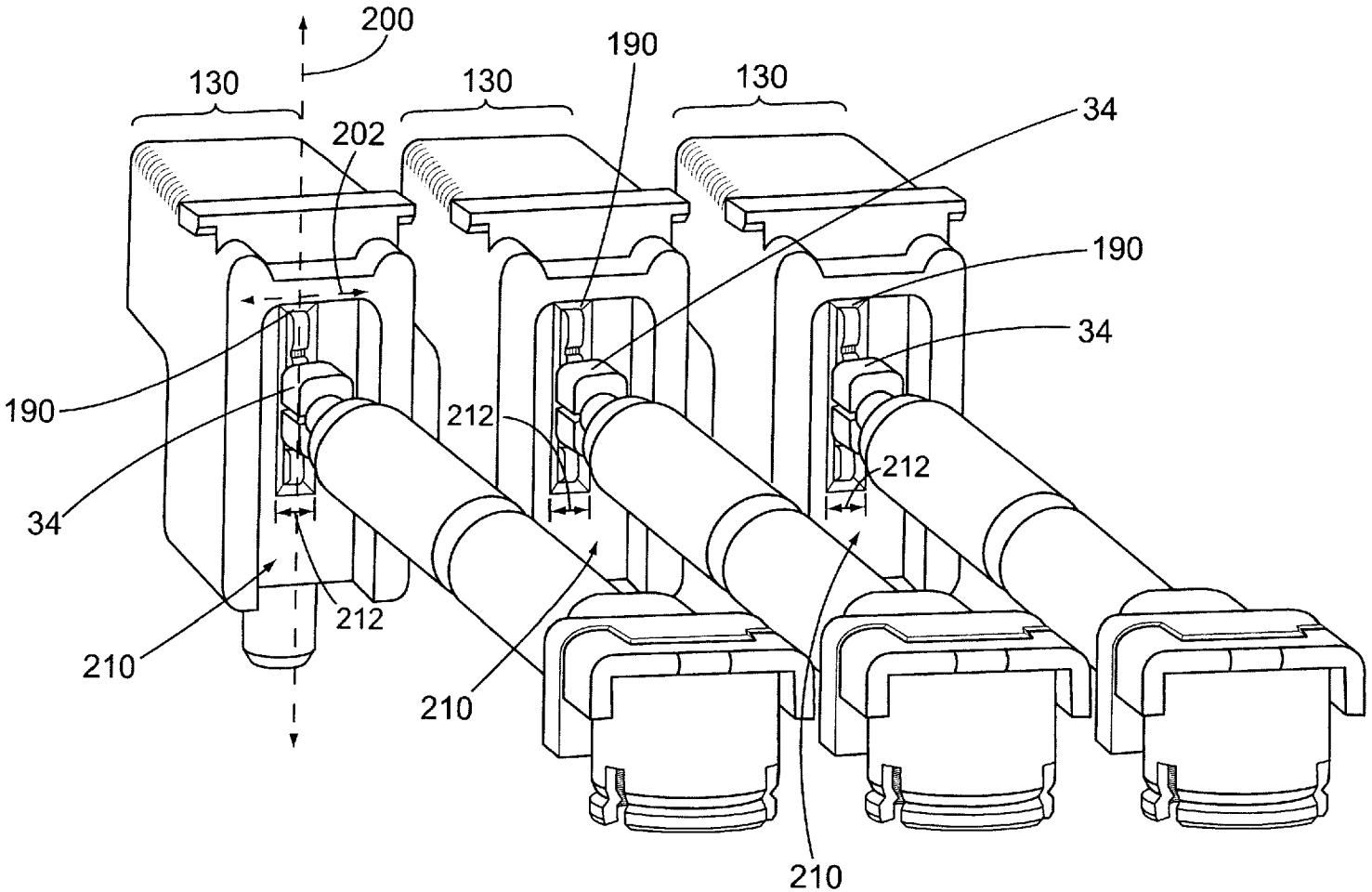
FIG. 6 is a rear perspective view of a plurality of dielectric bodies shown in FIG. 3.

FIG. 6 is a rear perspective view of the dielectric bodies 130. Each of the dielectric bodies 130 includes a back end 210 into which the center contacts 34 are inserted. The back end 210 of each dielectric body 130 includes the slot 190. The slot 190 is an opening that is elongated along a dielectric body transverse axis 200. In one embodiment, the dielectric body transverse axis 200 is substantially parallel to the yaw axis 140 (shown in FIG. 3). The slots 190 have a width 212 along a dielectric body lateral axis 202. In one embodiment, the dielectric body lateral axis 202 is substantially parallel to the pitch axis 142 (shown in FIG. 3). The width 212 of each slot 190 may be the greatest width of the slot 190 along the dielectric body lateral axis 202.

The center contacts 34 are inserted into the dielectric bodies 130 through the slots 190. In one embodiment, the dimple 154 and center contact 34 have a combined width that is greater than the width 212 of the slots 190. In such embodiments, when the center contact 34 is inserted into one of the slots 190, the dimple 154 may displace part of the dielectric body 130. Once the center contact 34 is inserted into the dielectric body 130, the dimple 154 may contact the inside of the dielectric body 130 so that the center contact 34 may partially pivot about the pitch axis 142 (shown in FIG. 3), as described above.

Similarly, the center contacts 180 (shown in FIG. 5) may be inserted into the dielectric bodies 130 through the slots 190. In one embodiment, when the center contact 180 is inserted into one of the slots 190, the dimple 184 may displace part of the dielectric body 130, as described above. As the flat surface 188 (shown in FIG. 5) of the dimple 184 angles away from the center contact 180, the center contact 180 may be easier to insert into the slot 190 when compared to the center contact 34 (shown in FIG. 4). Once the center contact 180 is inserted into the dielectric body 130, the dimple 184 may contact the inside of the dielectric body 130 so that the center contact 180 may partially pivot about the pitch axis 142 (shown in FIG. 3), as described above.

FIG. 7 is a bottom perspective view of a plurality of the dielectric bodies 130 with the center contacts 34 inserted therein. In the illustrated embodiment, each of the dielectric bodies 130 has an "L" shape. Alternatively, the dielectric bodies 130 may have a shape different from the "L" shape shown in FIG. 7.

An overhang portion 224 of the dielectric bodies 130 protrudes from a header portion 226 of the dielectric bodies 130. The overhang and header portions 224, 226 may be integrally formed with one another. Alternatively, the overhang and header portions 224, 226 may be separately formed and joined together. The overhang portion 224 extends between the cable end 66 and a front end 214. Similarly, the header portion 226 extends between the cable end 66 and the overhang portion 224. A portion of the header portion 226 defines a front end 216. As shown in FIG. 7, the front end 214 of the overhang portion 224 is disposed along a dielectric body longitudinal axis 220 at a forward location from the front end 216 of the header portion 226 in the illustrated embodiment. The dielectric body longitudinal axis 220 may be substantially perpendicular to the dielectric body transverse and lateral axes 200, 202 (shown in FIG. 6).

Each of the dielectric bodies 130 includes an alignment post 218 in one embodiment. The alignment post 218 includes a cylindrically shaped protrusion that extends from the header portion 226 along a post axis 222 in the illustrated embodiment. Alternatively, the alignment post 218 may have a different shape. The post axis 222 may be substantially perpendicular to the dielectric body longitudinal axis 220. In one embodiment, the post axis 222 is substantially parallel to the yaw axis 140 (shown in FIG. 3). The alignment post 218 permits the dielectric bodies 130 to at least partially pivot about the yaw axis 140.

Figure 8:
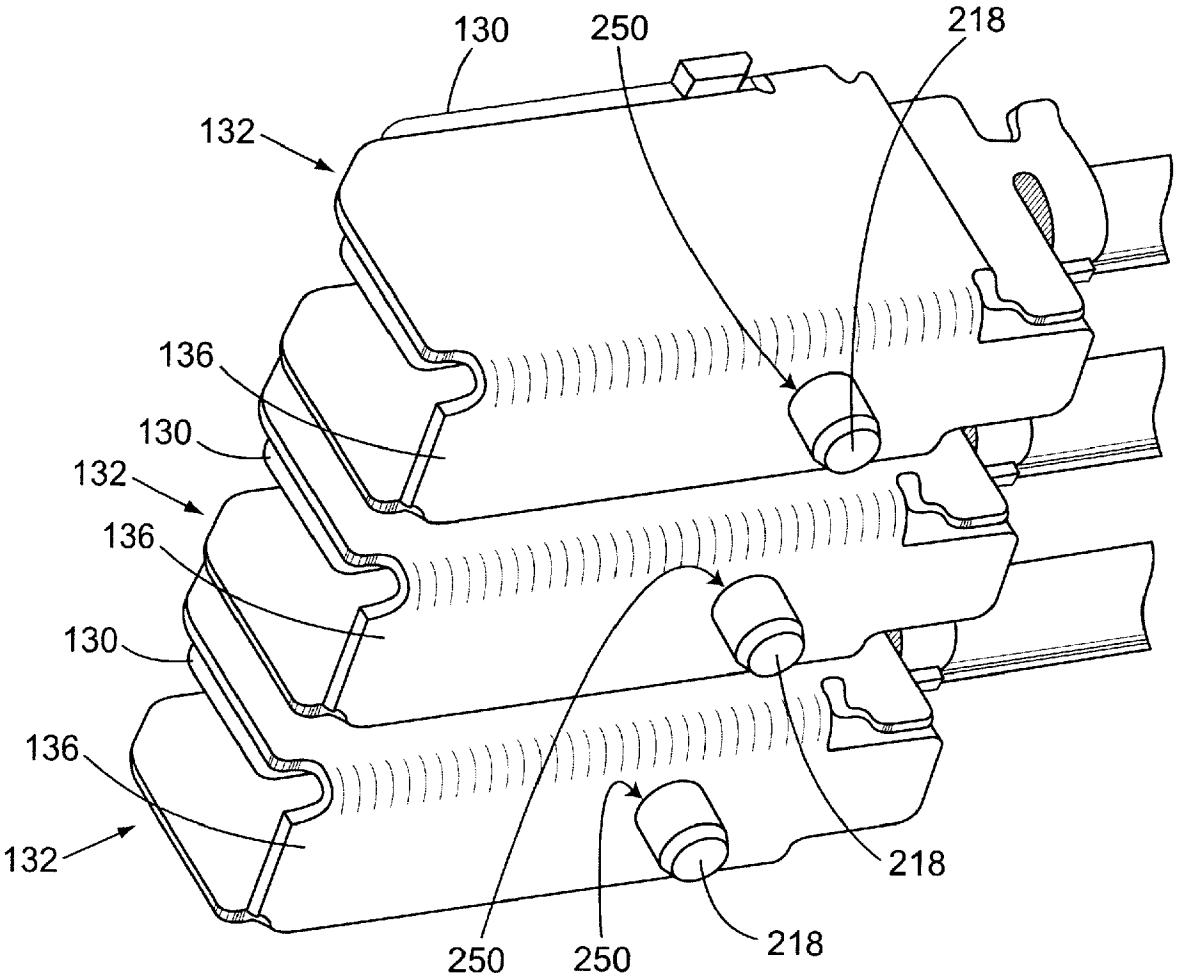
FIG. 8 is a bottom perspective view of the internal shields and dielectric bodies shown in FIG. 3.

FIG. 8 is a bottom perspective view of a plurality of the internal shields 132 and dielectric bodies 130. Each of the bottom walls 136 of each internal shield 132 includes an opening 250. The opening 250 is a cavity in the bottom wall 136 that is shaped to receive the alignment post 218 of the dielectric body 130. The alignment post 218 extends through the opening 250 and protrudes from the bottom wall 136.

FIG. 9 is a top perspective view of the bottom portion 70 of the housing 28 shown in FIGS. 2 and 4. The bottom portion 70 includes a plurality of cavities 260. Each of the cavities 260 is shaped to receive one of the alignment posts 218 (shown in FIG. 7) of the dielectric bodies 130 (shown in FIG. 7). The alignment post 218 of the dielectric body 130 is inserted into one of the cavities 260 after the dielectric body 130 has been placed in one of the internal shields 132 (shown in FIG. 3). In the illustrated embodiment, the cavities 260 partially extend into the bottom portion 70 in a direction that is substantially parallel to the housing transverse axis 62. Alternatively, the cavities 260 may extend all the way through the bottom portion 70 along the housing transverse axis 62. The insertion of the alignment posts 218 into the cavities 260 aligns the dielectric bodies 130 in directions along the housing longitudinal axis 60 and the housing lateral axis 64, while permitting the dielectric bodies 130 to pivot or partially rotate about the yaw axis 140 (shown in FIG. 3).

The bottom portion 70 includes a plurality of ribs 262 that extend in directions along the housing longitudinal axis 60. In another embodiment, the ribs 262 may be included in the top portion 68 (shown in FIG. 10). Alternatively, the ribs 262 may be included in both the top and bottom portions 68, 70. In the illustrated embodiment, the ribs 262 extend in directions that are substantially parallel to the housing longitudinal axis 60 partially between the interface 30 and cable end 66 of the bottom portion 70. The ribs 262 also protrude upwards in a direction that is substantially parallel to the housing transverse axis 62. In one embodiment, the number of ribs 262 exceeds the number of cavities 260 by one. For example, four ribs 262 may be provided (with only three shown in FIG. 9) for three cavities 260. A pair of ribs 262 is provided on opposing sides of each cavity 260, with two of the ribs 262 being provided between adjacent cavities 260. Alternatively, a different number of ribs 262 may be provided. For example, the number of cavities 260 may exceed the number of ribs 262 by one, with the outermost ribs 262 along the longitudinal axis 60 shown in FIG. 9 being omitted.

The ribs 262 may limit the distance that the receptacles 32 (shown in FIG. 1) can pivot about the yaw axis 140 (shown in FIG. 3) of each receptacle 32. For example, the dielectric body 130 and internal shield 132 may pivot about the yaw axis 140 and the alignment post 218 until the internal shield 132 contacts one of the ribs 262. A separation distance 264 between adjacent ones of the ribs 262 may be increased to increase the distance that the dielectric body 130 and internal shield 132 may pivot. The separation distance 264 may be decreased to decrease the distance that the dielectric body 130 and internal shield 132 may pivot. Thus, the ribs 262 may be positioned to provide a predetermined limited range of travel for each receptacle 32.

Each of a pair of side ridges 266, 268 extends in directions that are substantially parallel to the housing longitudinal axis 60 proximate to one of the opposing sides 86, 88 of the bottom portion 70. In the illustrated embodiment, the side ridges 266, 268 partially extend between the interface 30 and cable end 66. Alternatively, the side ridges 266, 268 may fully extend between the interface 30 and cable end 66. Each of the side ridges 266, 268 has a thickness 308. In one embodiment, the thickness 308 is the greatest exterior thickness of the side ridges 266, 268 in directions that are substantially parallel to the housing lateral axis 64.

The side ridges 266, 268 are separated from the opposing sides 86, 88 by a separation distance 270. In one embodiment, the separation distance 270 is approximately the same as a thickness 274 (shown in FIG. 10) of a pair of sidewalls 276, 278 (shown in FIG. 10).

The side ridges 266, 268 also protrude upwards in directions that are substantially parallel to the housing transverse axis 62 past the opposing sides 86, 88 by a height 272. In one embodiment, the height 272 is approximately the same as a separation distance 280 (shown in FIG. 10) between the sidewall 276 (shown in FIG. 10) and a ledge 320 (shown in FIG. 10) adjacent to the sidewall 276, and between the sidewall 278 (shown in FIG. 10) and the ledge 320 adjacent to the sidewall 278.

A back ridge 282 partially extends between the opposing sides 86, 88 in a direction that is substantially parallel to the housing lateral axis 64. The back ridge 282 also protrudes upwards in a direction that is substantially parallel to the housing transverse axis 62 by a height 288. In the illustrated embodiment, the back ridge 282 includes a plurality of gaps 286. In one embodiment, the height 288 is the greatest height of the back ridge 282 in a direction that is substantially parallel to the housing transverse axis 62. The back ridge 282 has a lower height 290 in a direction that is substantially parallel to the housing transverse axis 62 at each of the gaps 286. In one embodiment, the lower height 290 is the greatest height of the back ridge 282 in a direction that is substantially parallel to the housing transverse axis 62 at each of the gaps 286.

Each of the gaps 286 is aligned in a direction that is substantially parallel to the housing longitudinal axis 60 with one of a plurality of channels 284. The channels 284 have an arcuate cross-section in one embodiment. The channels 284 extend substantially parallel to the housing longitudinal axis 60 between the cable end 66 and the back ridge 282. The channels 284 mechanically support the cables 36 (shown in FIG. 1) when the dielectric bodies 130, internal shields 132, center contacts 34 and cables 36 are placed in the bottom portion 70. The channels 284 may reduce the mechanical strain on the cables 36 during use of the receptacle connector assembly 14 (shown in FIG. 1).

Each of a pair of alignment pins 292 protrude upwards in a direction that is substantially parallel to the housing transverse axis 62 from the bottom portion 70. In another embodiment, a different number of alignment pins 292 are included in the bottom portion 70. The alignment pins 292 each have an alignment pin diameter 294. In one embodiment, the alignment pin diameter 294 is the greatest exterior width of the alignment pin 292 in a plane that extends along the housing transverse axis 64 and the housing longitudinal axis 60. The alignment pins 292 are inserted into an alignment cavity 296 (shown in FIG. 10) of the top portion 68 (shown in FIG. 2) to secure the top and bottom portions 68, 70 together.

Each of a pair of alignment cavities 298 extend into the bottom portion 70 in a direction that is substantially parallel to the housing transverse axis 62. In another embodiment, a different number of alignment cavities 298 are included in the bottom portion 70. The alignment cavities 298 each have an alignment cavity diameter 300. In one embodiment, the alignment cavity diameter 300 is the greatest exterior width of the alignment cavity 298 in a plane that extends along the housing longitudinal axis 60 and the housing transverse axis 64. Each of the alignment cavities 298 receives an alignment pin 306 (shown in FIG. 10) of the top portion 68 (shown in FIG. 2) to secure the top and bottom portions 68, 70 together.

In one embodiment, a plurality of inner walls 302 are provided within the alignment cavities 298 to form the shape of a polygon within each of the alignment cavities 298. The inner walls 302 contact a corresponding one of the alignment pins 306 (shown in FIG. 10) when the alignment pin 306 is inserted into the alignment cavity 298. For example, the inner walls 302 may tangentially contact the alignment pin 306 to provide a friction fit connection between the alignment cavity 298 and the alignment pin 306.

Figure 10:
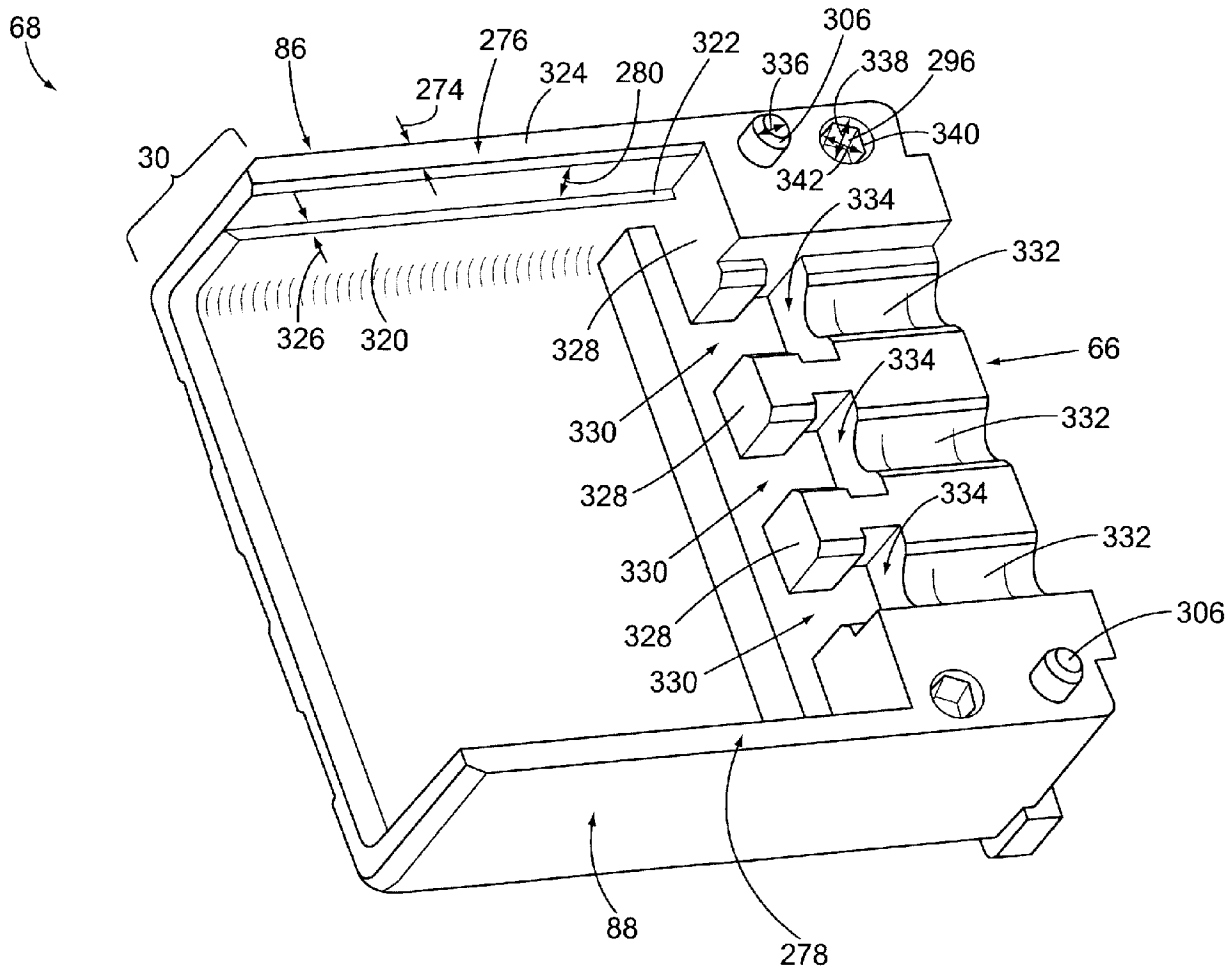
FIG. 10 is a bottom perspective view of a top portion of the housing shown in FIG. 9.

In the illustrated embodiment, the inner walls 302 form the shape of a hexagon. In other embodiments, the inner walls 302 may form the shape of a triangle, a quadrilateral, a rectangle, a square, a parallelogram, a rhombus, a pentagon, a heptagon, an octagon, a nonagon, a decagon, or other polygon. In one embodiment, an inner distance 304 separates opposing pairs of the inner walls 302 in one of the alignment cavities 298. For example, the inner distance 304 may be the greatest distance between two inner walls 302 across from one another in one of the alignment cavities 298 in a plane that extends along the housing transverse and longitudinal axes 64, 60. In one embodiment, the inner distance 304 is approximately the same as, or smaller than, an alignment pin diameter 336 of the alignment pin 306 of the top portion 68, as shown in FIG. 10. In such an embodiment, the alignment pin 306 of the top portion 68 may be held within the alignment cavity 298 through a friction fit connection.

FIG. 10 is a bottom perspective view of the top portion 68 of the housing 28 shown in FIGS. 2 and 3. The top portion 68 includes a pair of the ledges 320 that each extends in a direction that is substantially parallel to the housing longitudinal axis 60 (shown in FIG. 2) proximate to each of the opposing sides 86, 88 of the top portion 68. In the illustrated embodiment, the ledges 320 partially extend between the interface 30 and the cable end 66. Alternatively, the side ledges 320 may fully extend between the interface 30 and cable end 66.

A top edge 322 of each ledge 320 is separated from a top edge 324 of the opposing sides 86, 88 by the separation distance 280. The ledges 320 have a ledge thickness 326. In one embodiment, the ledge thickness 326 is the greatest width of each of the ledges 320 in a direction that is substantially parallel to the housing lateral axis 64 (shown in FIG. 2). In one embodiment, the ledge thickness 326 is approximately the same as the thickness 308 (shown in FIG. 9) of the side ridges 266, 268 (shown in FIG. 9) of the bottom portion 70 (shown in FIG. 9). The opposing sides 86, 88 have a thickness 274. In one embodiment, the thickness 274 is the greatest width of the opposing sides 86, 88 in a direction that is substantially parallel to the housing lateral axis 64. In one embodiment, the thickness 274 is approximately the same as the separation distance 270 (shown in FIG. 9).

The side ridges 266, 268 (shown in FIG. 9) of the bottom portion 70 (shown in FIG. 9) and the ledges 320 of the top portion 68 may have complementary shapes. For example, the side ridges 266, 268 and ledges 320 may contact one another when the top and bottom portions 68, 70 are mated as shown in FIG. 3.

A plurality of back walls 328 are provided in a location that is proximate to the cable end 66 of the top portion 68. The back walls 328 may extend in directions that are substantially parallel to the housing lateral and transverse axes 64, 62 (shown in FIG. 2). The back walls 328 are separated from one another by a plurality of gaps 330. Each of the gaps 330 is aligned with one of a plurality of channels 332.

The channels 332 are similar to the channels 284 (shown in FIG. 9) of the bottom portion 70 (shown in FIG. 9) in one embodiment. The channels 332 may have an arcuate cross-section. Each of the channels 332 extends in a direction that is substantially parallel to the housing longitudinal axis 60 (shown in FIG. 2) between the cable end 66 and a ground cradle cavity 334. The channels 332 mechanically support the cables 36 (shown in FIG. 1) when the dielectric bodies 130, internal shields 132, center contacts 34 and cables 36 (shown in FIG. 7) are placed in the bottom portion 70 and the top portion 68 is connected with the bottom portion 70. The channels 332 may reduce the mechanical strain on the cables 36 during use of the receptacle connector assembly 14 (shown in FIG. 1). The channels 284, 332 may combine to surround each of the cables 36 at the cable end 66 of the housing 28.

Each of the ground cradle cavities 334 partially extends through the top portion 68 in a direction that is substantially parallel to the housing transverse axis 62 (shown in FIG. 2). Alternatively, the ground cradle cavities 334 may extend all the way through the top portion 68.

Similar to the alignment pins 292 (shown in FIG. 9) of the bottom portion 70 (shown in FIG. 9), the alignment pins 306 protrude away from the top portion 68 in a direction that is substantially parallel to the housing transverse axis 62. In another embodiment, a different number of alignment pins 306 are included in the top portion 68. The alignment pins 306 each have an alignment pin diameter 336. In one embodiment, the alignment pin diameter 336 is the greatest exterior width of the alignment pin 306 in a plane that extends along the housing lateral and longitudinal axes 64, 60 (shown in FIG. 2). The alignment pin diameter 336 may be approximately the same as the alignment pin diameter 294 (shown in FIG. 9) of the alignment pins 292 in the bottom portion 70. Each of the alignment pins 306 may be inserted into a corresponding one of the alignment cavities 298 (shown in FIG. 9) of the bottom portion 70 to secure the top and bottom portions 68, 70 together.

Similar to the alignment cavities 298 of the bottom portion 70 shown in FIG. 9, each of a pair of alignment cavities 296 extend into the top portion 68 in a direction that is substantially parallel to the housing transverse axis 62 (shown in FIG. 2). In another embodiment, a different number of alignment cavities 296 are included in the top portion 68. The alignment cavities 296 each have an alignment cavity diameter 338. In one embodiment, the alignment cavity diameter 338 is the greatest exterior width of the alignment cavity 296 in a plane that extends along the housing longitudinal and lateral axes 60, 64 (shown in FIG. 2). Each of the alignment cavities 296 receives one of the alignment pins 292 (shown in FIG. 9) of the bottom portion 70 (shown in FIGS. 2 and 9) to secure the top and bottom portions 68, 70 together.

In one embodiment, a plurality of inner walls 340 is provided within the alignment cavities 296 to form the shape of a polygon within each of the alignment cavities 296, similar to the inner walls 302 shown in FIG. 9. In one embodiment, an inner distance 342 separates opposing pairs of the inner walls 340 in one of the alignment cavities 296. For example, the inner distance 342 may be the greatest distance between two inner walls 340 across from one another in one of the alignment cavities 296 in a plane that extends along the longitudinal housing longitudinal and lateral axes 60, 64 (shown in FIG. 2). In one embodiment, the inner distance 342 is approximately the same as, or smaller than, the alignment pin diameter 294 of the alignment pin 292 of the bottom portion 70, as shown in FIG. 9. In such an embodiment, the alignment pin 292 of the bottom portion 70 may be held within the alignment cavity 296 through a friction fit connection.

Once the top and bottom portions 68, 70 are secured together, the electrical connector 18 (shown in FIG. 1) of the device 16 (shown in FIG. 1) may be inserted into the receptacle connector assembly 14 (shown in FIG. 1). As described above, the center contact 34 (shown in FIGS. 3 and 4) may be aligned with the electrical contacts 26 (shown in FIG. 1) of the electrical connector 18 by pivoting the center contact 34 about the pitch axis 142 (shown in FIG. 3) and/or by pivoting the receptacle 32 (shown in FIG. 3) about the yaw axis 140.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first" "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a housing having an interior chamber between a cable end and an interface of the housing, the interface being configured to engage a mating end of a mating electrical connector;

a receptacle pivotally held in the housing at the interface such that the receptacle pivots relative to the housing about a yaw axis; and a receptacle contact disposed within the receptacle and configured to engage a corresponding contact in the mating electrical connector, the receptacle contact pivotally mounted in the receptacle such that the receptacle contact pivots relative to the housing and the receptacle about a pitch axis to align with the corresponding contact in the mating electrical connector.

2. The connector assembly of claim 1, wherein the receptacle is mounted so as to pivot in the interior chamber, the receptacle being capable of pivoting about the yaw axis within the interior chamber over a predetermined limited range of travel to align the receptacle contact with the corresponding contact in the mating electrical connector.

3. The connector assembly of claim 2, wherein the housing comprises one or more ribs in the interior chamber, the ribs being positioned to provide the predetermined limited range of travel.

4. The connector assembly of claim 2, wherein the receptacle comprises a dielectric body holding the receptacle contact, the dielectric body having a post that extends away from the dielectric body and is mounted so as to pivot the dielectric body about the post relative to the housing in the interior chamber.

5. The connector assembly of claim 1, wherein the housing extends along a housing longitudinal axis between the interface and the cable end, the interface extends along a housing transverse axis and a housing lateral axis, the housing longitudinal, transverse and lateral axes being substantially perpendicular to one another.

6. The connector assembly of claim 5, wherein the pitch axis is substantially parallel to the housing lateral axis.

7. The connector assembly of claim 1, wherein the connector assembly comprises a plurality of the receptacles and the receptacle contacts, each of the receptacle contacts configured to pivot about a respective pitch axis independent of the other receptacle contacts to align with one of a plurality of corresponding contacts in the mating electrical connector.

8. An electrical connector assembly comprising:

a housing having an interior chamber between a cable end and an interface of the housing, the interface being configured to receive a mating end of a mating electrical connector;

a receptacle held in the housing at the interface, the receptacle being mounted so as to pivot in the interior chamber, the receptacle configured to pivot about a yaw axis within the interior chamber over a predetermined limited range of travel; and a receptacle contact disposed within the receptacle and configured to engage a corresponding contact in the mating electrical connector, the receptacle capable of pivoting about the yaw axis to align the receptacle contact with the corresponding contact in the mating electrical connector; wherein the receptacle contact is pivotally mounted within a slot of the receptacle, the receptacle contact being configured to pivot about a pitch axis and along the slot of the receptacle to align with the corresponding contact in the mating electrical connector.

9. The connector assembly of claim 8, wherein the housing comprises one or more ribs in the interior chamber, the ribs being positioned to provide the predetermined limited range of travel.

10. The connector assembly of claim 8, wherein the receptacle comprises a dielectric body holding the receptacle contact, the dielectric body having a post that extends away from the dielectric body and is mounted so as to pivot in the interior chamber.

11. The connector assembly of claim 8, wherein the housing extends along a housing longitudinal axis between the interface and the cable end, the interface extends along a housing transverse axis and a housing lateral axis, the housing longitudinal, transverse and lateral axes being substantially perpendicular to one another.

12. The connector assembly of claim 11, wherein the yaw axis is substantially parallel to the housing transverse axis.

13. The connector assembly of claim 8, wherein the connector assembly comprises a plurality of the receptacles and the receptacle contacts, each of the receptacles configured to pivot about a respective yaw axis independent of the other receptacles to align a corresponding one of the receptacle contacts with one of a plurality of corresponding contacts in the mating electrical connector.

14. An electrical connector assembly comprising:

a housing having an interior chamber between a cable end and an interface of the housing, the interface being configured to receive a mating end of a mating electrical connector;

a receptacle held in the housing at the interface, the receptacle being mounted so as to pivot relative to the housing in the interior chamber, the receptacle configured to pivot about a yaw axis within the interior chamber over a predetermined limited range of travel; and a receptacle contact disposed within a slot of the receptacle and configured to engage a corresponding contact in the mating electrical connector, the receptacle contact being pivotally mounted in the receptacle and configured to pivot about a pitch axis relative to the receptacle and along the slot of the receptacle, the receptacle and the receptacle contact configured to pivot to align the receptacle contact with the corresponding contact in the mating electrical connector.

15. The connector assembly of claim 14, wherein the housing comprises one or more ribs in the interior chamber, the ribs being positioned to provide the predetermined limited range of travel.

16. The connector assembly of claim 14, wherein the receptacle comprises a dielectric body holding the receptacle contact, the dielectric body having a post that extends away from the dielectric body and is mounted so as to pivot in the interior chamber.

17. The connector assembly of claim 14, wherein the connector assembly comprises a plurality of the receptacles and the receptacle contacts, each of the receptacle contacts configured to pivot about a respective pitch axis independent of the other receptacle contacts, each of the receptacles configured to pivot about a respective yaw axis independent of the other receptacles.

18. The connector assembly of claim 14, wherein the housing extends along a housing longitudinal axis between the interface and the cable end, the interface extends along a housing transverse axis and a housing lateral axis, the housing longitudinal, transverse and lateral axes being substantially perpendicular to one another.

19. The connector assembly of claim 18, wherein the yaw axis is substantially parallel to the housing transverse axis and the pitch axis is substantially parallel to the housing lateral axis.

* * * * *